United States Patent [19]

Dehue

[11] 4,331,199

[45] May 25, 1982

[54] APPARATUS FOR RECOVERING ENERGY FROM A HEATING INSTALLATION

[75] Inventor: Jozef J. E. Dehue, Roermond, Netherlands

[73] Assignee: B.V. Interpower, Roermond, Netherlands

[21] Appl. No.: 176,526

[22] Filed: Aug. 8, 1980

[30] Foreign Application Priority Data

Aug. 9, 1979 [NL] Netherlands ..... 7906088

[51] Int. Cl.[3] ..... F28F 27/00

[52] U.S. Cl. ..... 165/39; 165/74; 165/111; 165/122; 165/164; 165/DIG. 12; 165/47; 122/20 B; 431/120

[58] Field of Search ..... 165/DIG. 12, 39, 47, 165/74, 111, 122, 164, 76, 95; 122/20 B; 431/120

[56] References Cited

U.S. PATENT DOCUMENTS

| | | | |
|---|---|---|---|
| 3,095,923 | 7/1963 | Foutz | 165/164 |
| 3,542,018 | 11/1970 | Quick | 431/120 |
| 4,185,685 | 1/1980 | Giberson | 122/20 B |
| 4,215,741 | 8/1980 | Averbuch et al. | 165/DIG. 12 |

FOREIGN PATENT DOCUMENTS

| | | | |
|---|---|---|---|
| 2820826 | 11/1979 | Fed. Rep. of Germany | 122/20 B |

*Primary Examiner*—Albert W. Davis
*Assistant Examiner*—Margaret A. Focarino
*Attorney, Agent, or Firm*—Cushman, Darby & Cushman

[57] ABSTRACT

An apparatus for recovering energy that can be incorporated in the flue gas discharge duct of a gas or oil fired heating installation which uses a liquid circuit to transfer heat. The apparatus is comprised of supply and discharge connections for the flue gas, a heat exchanger to be incorporated in the liquid circuit, a condensate collection and discharge device, and a fan to force the flue gas flow past the heat exchanger.

19 Claims, 4 Drawing Figures

APPARATUS FOR RECOVERING ENERGY FROM A HEATING INSTALLATION

The invention relates to an apparatus for recovering energy that can be incorporated in the flue gas discharge duct of a gas or oil fired heating installation which uses a liquid circuit to transfer heat. The present invention is comprised of supply and discharge connections for the flue gases, a heat exchanger to be incorporated in the liquid circuit, a condensate collection and discharge device, and a fan to force the flue gas flow past the heat exchanger.

BACKGROUND OF THE INVENTION

An apparatus according to the present invention can be used to supplement a conventional central heating boiler using a liquid circuit by recovering the heat from the off-gases and transferring their energy to the heating liquid which is normally water. This apparatus can either be incorporated detachably in the flue gas duct, or, if desired, it can also form an integral part of the boiler.

A similar device is described in NL-A-7612508, but in addition to the elements set forth above, that device also consists of a heating device for off gases that have already been cooled, while the fan has the added capability of adding fresh air. By condensing water from the flue gas that device achieves a substantial heat transfer from the flue gas to the returning heating water. However, the description of that device states that it is necessary to reheat the cooled flue gas and to supply fresh air to prevent condensation in the flue. This, of course, involves a loss of efficiency and requires additional fan capacity. Therefore, that design is less suited for the construction of a very compact but yet accessible unit which can be made relatively cheaply through mass production.

One object of the present invention is to provide an apparatus for recovering energy which overcomes the disadvantages of the device disclosed in NL-A-7612508. Thus, a suitable apparatus must have the following properties:

(1) a good heat transfer capacity, (2) good condensation properties for the water of the flue gas, (3) a slight resistance for the flue gas with little occasion for fouling, and (4) simple initial installation procedure.

Additionally, the apparatus must also have the following design features:

(1) a simple design, aimed at mass production, (2) a compact design, requiring a short overall length and little space, and (3) a design permitting essential parts to be overhauled and cleaned in a simplified manner.

DESCRIPTION OF THE INVENTION

All seven of the requirements set forth above are achieved by the unique and novel design of the present apparatus. Specifically, the present apparatus contains:

(1) a heat exchanger with an elongated body of which:

a. the central part is formed by the walls of two cavities or sets of cavities running parallel in longitudinal direction; and b. the walls of the central part, on both sides of both cavities, are provided with longitudinal ribs;

(2) said heat exchanger is incorporated in a heat insulating box so that the spaces between the longitudinal ribs, the inner wall of the box and the central part of the heat exchanger form ducts for flue gases to be cooled;

(3) the supply and discharge connections for the flue gases are passed through the insulating box in a location so that from the supply connection the flue gases will first flow through the ducts on one side of the heat exchanger and subsequently return to the discharge connection through the ducts on the other side;

(4) the ducts of the installed heat exchanger incline toward a spaced formed by one end of the ducts and the inner wal of the box, where a tube pointing downwards is in open connection with the lower part of the space and the exterior of the box;

(5) means are present to influence the size of the flow of flue gas to be passed through the heat exchanger; and (6) facilities are present to pass the liquid from the supply connection of the liquid circuit through one cavity or one set of cavities of the heat exchanger and to return it to the discharge connection through the other cavity or set of cavities.

In essence, the heat recovery apparatus of the present invention operates as follows. The hot flue gas supplied from the boiler flows in longitudinal direction through a set of parallel ducts of the heat exchanger and, via the ribs separating the ducts, transfers sensible heat and condensation heat to a heating medium also flowing in longitudinal direction. To ensure that the heat transfer is virtually the same across the full height of the ribs, the ribs widen toward their base. In part because the ribs are preferably smooth in longitudinal direction, condensate formation is affected favorably. The use of a heat exchanger with smooth tubing to a large extent satisfies the second set of design requirements set forth above.

The heat exchanger can be manufactured from a seamless extruded body of an aluminum alloy and can thus be made in a simple and cheap way. The external circumferential configuration of the cross section is preferably either rectangular or round and fits into a box of either rectangular or round cross section, respectively. The central part contains two adjacent cavities or two sets of cavities and will have a width exceeding its height. The ribs, which can number in the range of 10 to 30, have the two longer sides of the central part as their bases.

According to the preferred embodiment of the invention both the flue gases and the water are supplied to one end of the body and flow in a longitudinal direction. The return flows are also in a longitudinal direction. Gas flow and liquid flow thus are parallel with the supply and discharge connections for the flue gases being in an inline configuration. The apparatus can, therefore, easily and with its short overall length be incorporated in an existing pipe of a flue gas discharge duct.

To obtain a compact design, the fan forcing the flue gases through the ducts can form part of the flue gas discharge connection and therefore border immediately on the flue gas ducts of the heat exchanger. Another possibility is to install the fan in said space where the gases turn. This has the advantage that the turning resistance for the gases is eliminated and an even smaller overall height can be obtained. Of course, condensed water must be prevented from passing the fan. Therefore the design in both aforesaid cases should be provided with means to keep condensed water outside the fan and to lead it into a discharge pipe. According to the first design a discharge pipe is present between the discharge connection for the flue gases and one or more ducts of the heat exchanger parallel to the fan, and means are provided to keep condensed water outside the fan and lead it into the discharge pipe.

It will be necessary to periodically inspect, clean and/or overhaul the heat exchanger and/or the fan. For this reason, the box is provided with a detachable cover plate, positioned near the connections for the supply and discharge of the flue gases, to which the heat exchanger is attached and through which the connections of the liquid circuit are passed. Preferably, the fan is also attached to this plate, so that the heat exchanger and fan can as one unit be removed from the box at the same time. To enable this to be done in a simple way and at regular intervals, the water supply and discharge are preferably provided with flexible hoses. The cover plate is fixed onto its seat by means of clamping bolts on the opposite side of the box and via the body of the heat exchanger. A similar design, in which a cover plate together with the fan and the heat exchanger are removable as one unit is also possible if the fan is situated in the turning space. Since the heat exchanger and the box incline when installed, the axis of the mounted fan also inclines at the same angle, e.g. about 7°, which will prolong bearing life.

Also essential for the optimum efficiency of the heating installation proper, i.e. of the boiler, is the capability of regulating the flow of the flue gas. This can, for example, be accomplished through optimizing the use of the amount of flue gas and thereby optimizing the amount of $CO_2$ in the flue gas by varying the speed of the fan. This method is not very feasible for the average installation. For this reason, flow restricting means are preferably installed in the flue gas duct, which will have dimensions dictated by the capacity of the boiler.

By preference these flow restricting means consist of an orifice plate, detachably mounted on the fan outlet. The width of the orifice plate is dependent on the desired flue gas flow for a given certain boiler capacity. Thus, the installer only needs to install the orifice plate corresponding to a given boiler capacity. A further advantage of the orifice plate is that the chimney dependence of the entire installation is reduced.

It is of course important for the installation to function under safe conditions. This is especially true for the fuel supply and for the fan. It is possible that the boiler, the heat exchanger, the orifice plate or the chimney may become fouled, resulting in the situation where the discharge of flue gas is insufficient or blow-back occurs. For this reason, a temperature sensor and a gas flow sensor are present in one or both of the flue gas ducts. These are designed so that they can either separately or together control the fuel supply and the fan operation. The critical operating and control parameters are as follows:

(1) as long as the temperature sensor senses an increased temperature as a result of the presence of flue gases, the fan will operate;

(2) as long as the gas flow sensor detects an insufficient amount of flue gas, the fuel supply will be shut off; and (3) the fuel supply will not be opened until the gas flow sensor has signalled that enough air is being transported.

Preferably the temperature sensor is present in the hotter gas flow; i.e. in the flue gas supply connection. The gas flow sensor preferably is present in the cooler gas flow; i.e. in the flue gas discharge connection, since this flow varies least in temperature. The wiring circuit of the energy recovery apparatus and that of the boiler are preferably kept separated.

With respect to the materials of construction employed in the present invention, the entire unit is preferably made of aluminum or aluminum alloys, and the box is heat insulated with rock wool. To prevent condensed water from a flue gas leak from remaining behind in the insulating material, the box is provided with a number of vents which open externally. To prevent electrochemical corrosion, the brass or steel of the connections of the water supply and discharge and the aluminium of the heat exchanger, are electrically insulated.

BRIEF DESCRIPTION OF THE DRAWINGS

The energy recovery apparatus according to the present invention can be elucidated by the following drawings.

DETAILED DESCRIPTION OF THE DRAWINGS

Figure 2:
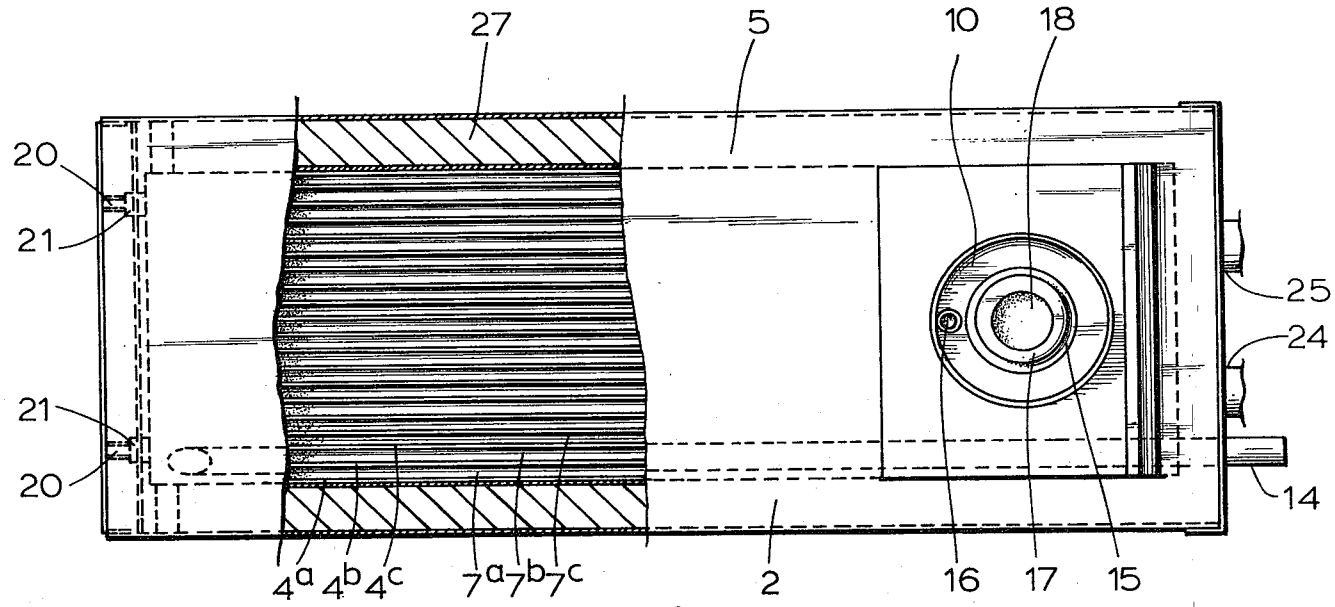
FIG. 2 shows a partly cutaway top view.
Figure 3:
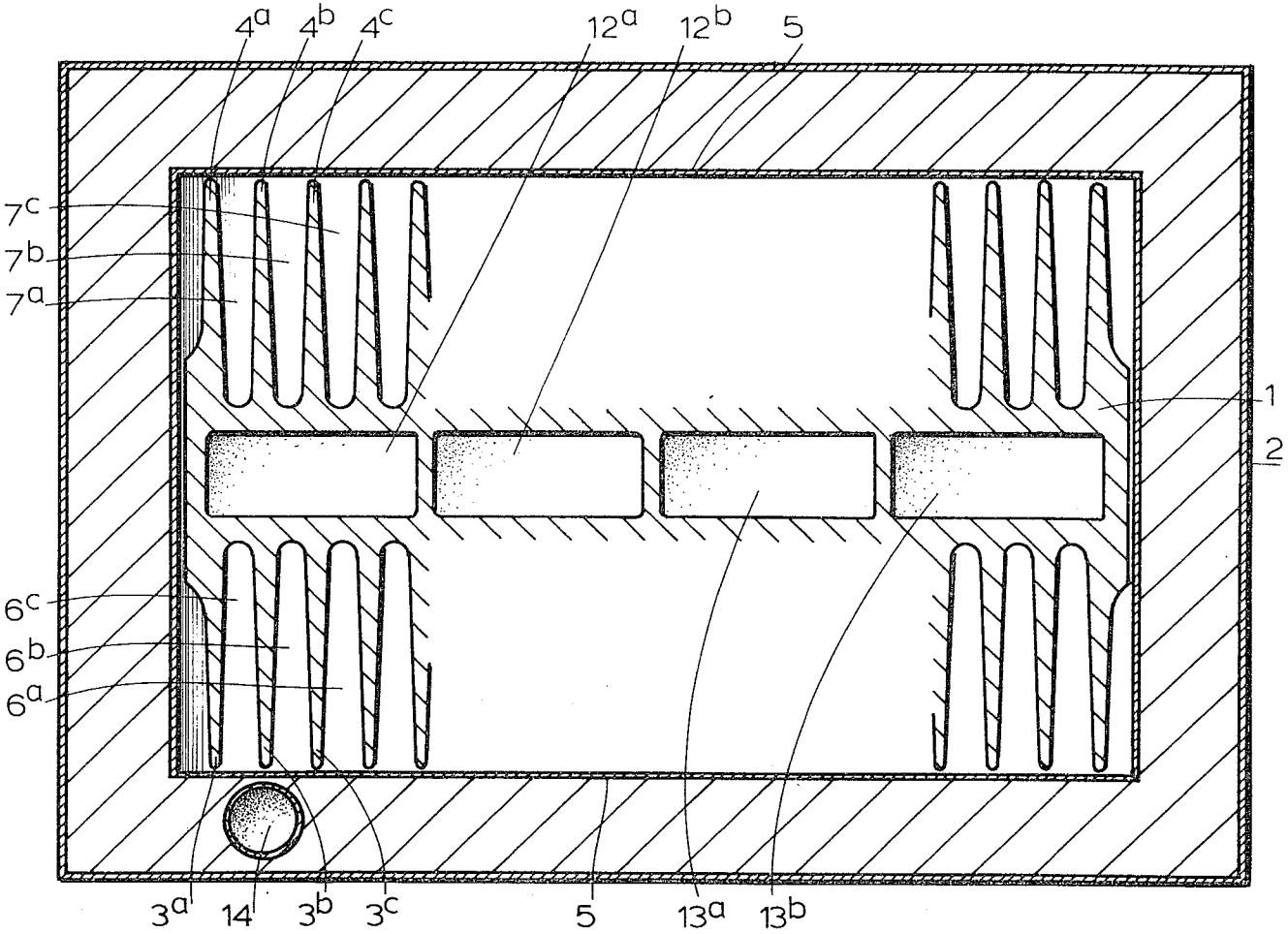
FIG. 3 shows a section of the heat exchanger along line A—A.

The energy recovery apparatus comprises the following main parts: a heat exchanger 1 in mounted condition is incorporated in an insulating box 2. FIG. 2 shows a part of this heat exchanger in top view, and FIG. 3 in section. The body of heat exchanger 1 is rectangular in cross section and has on opposite sides of its central part ribs 3*a*, 3*b*, 3*c*, etc. and 4*a*, 4*b*, 4*c*, etc., respectively. These ribs, together with inner wall 5 of box 2, form virtually separated ducts 6*a*, 6*b*, 6*c*, etc. on one side, and ducts 7*a*, 7*b*, 7*c*, etc. on the opposite side. In the center, ribs 3 and 4 are, for instance, about 5 mm apart and their height is about 40 mm; ducts 6 and 7 thus have a relatively wide passage and, consequently, little resistance and can easily be cleaned. Via flue gas supply connection 8, which connects to the flue gas discharge of a central-heating boiler (not shown in the drawing), hot flue gases are passed to chamber 9 via ducts 6, where they turn and return to flue gas discharge connection 10 via ducts 7. In said flue gas discharge connection 10 a centrifugal fan 11 is incorporated that maintains the transport of flue gas. To achieve that the flue gases traverse the longest possible path through ducts 6 and 7 baffles 28 and 29 are installed near flue gas connection 8 and discharge connection 10. In this central part, body 1 also has cavities through which the water to be heated is passed. The water flows in the direction of chamber 9 via cavities 12*a* and 12*b* and returns through cavities 13*a* and 13*b*. Ribs 3 and 4, which form ducts 6 and 7 respectively with inner wall 5 of box 2, form a path for the transport of the heat delivered by the gases to the water in cavities 12 and 13.

Because the heat exchanger 1 is inclined in box 2, condensed water will flow to the bottom of chamber 9 through ducts 7 and over the bottom of box 2. From there the collected water is discharged via pipe 14. Any condensed water that may flow back behind fan 11 is kept away from the fan by upright edge 15 and can flow to one or more of ducts 7 via discharge pipe 16 and be discharged together with the rest of the condensed water.

Upright edge 15 is now also used to attach an exchangeable orifice plate 17 to it, for instance by clamping it onto edge 15. Orifice plate 17 has an orifice 18 which is adapted to the size of the boiler.

Heat exchanger 1 and fan 11 are fixed to cover plate 19. This plate 19 is kept in a tight and sealing position on its seat 22 via body 1 and bolts 20 with nuts 21. By loosening nut 21, after removal of protective cap 23, heat exchanger 1 and fan 11 can be removed from box 2 as one unit with plate 19. For this purpose water supply and discharge connections 24 and 25 are provided with flexible hoses. Via coupling 26, which is made of plastic material, these connections 24 and 25 are connected with cavities 12 and 13 from which they are electrically insulated, contact with cover 30 being avoided. Box 2 is filled with rock wool 27, which is bound with a binding agent capable of withstanding a sufficiently high temperature. When mounted, both heat exchanger 1 and box 2 may incline. By preferance, the axis of fan 11 also inclines, as is shown by FIG. 1.

Figure 1:
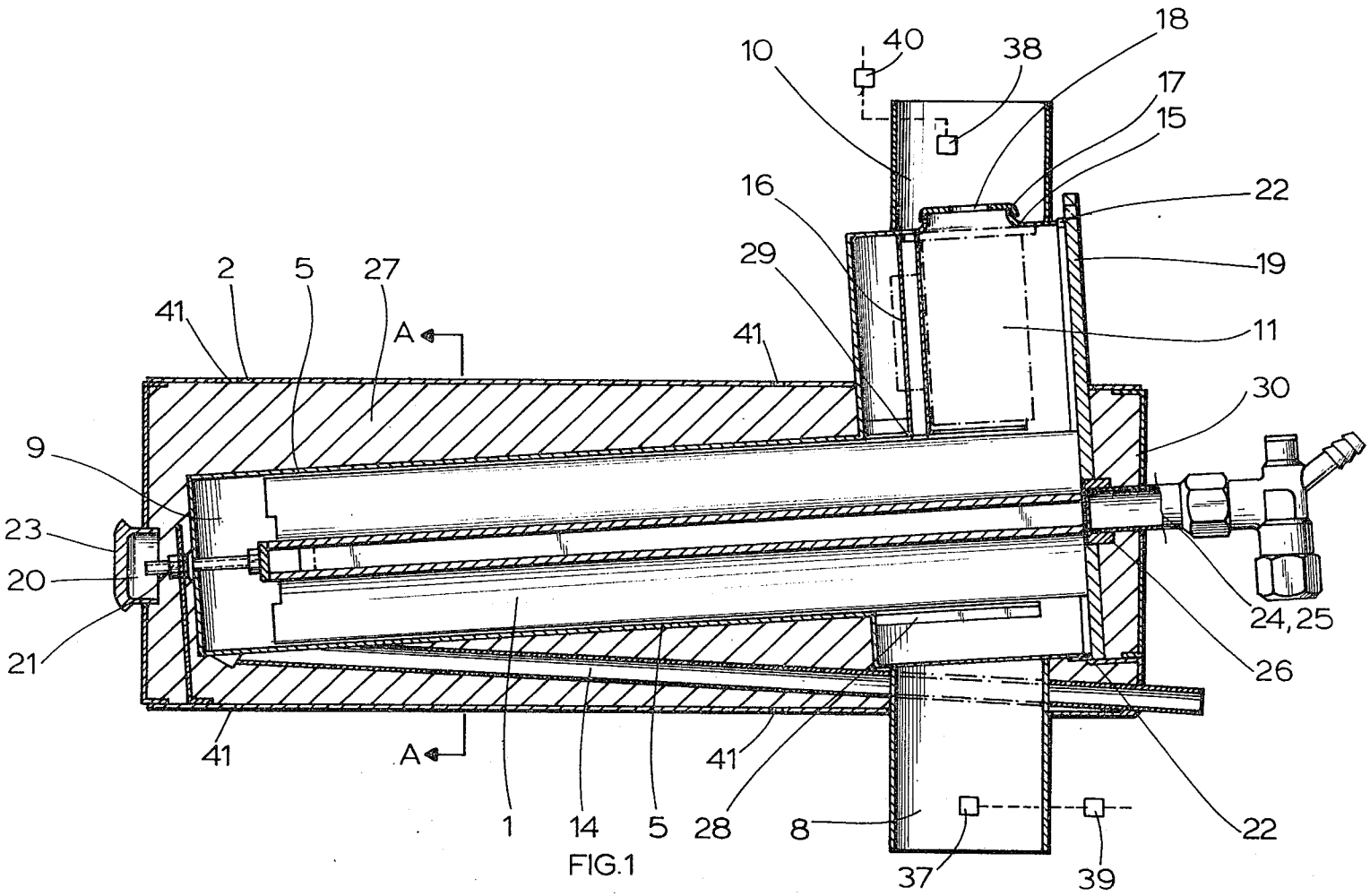
FIG. 1 shows a longitudinal section.

The temperature and the gas flow sensors are shown in FIG. 1. The temperature sensor 37 is preferably located in flue gas supply connection 8, the flue gas flow sensor 28 above orifice 18 of orifice plate 17. Both sensors are connected to an electric circuit through connectors 39 and 40. The operation of these sensors, as already described, is deemed to form part of the essence of the invention. To prevent condensed water from a flue gas leak from remaining behind in the insulating material 27, the box 2 is provided with a number of vents 41, which open externally.

Figure 4:
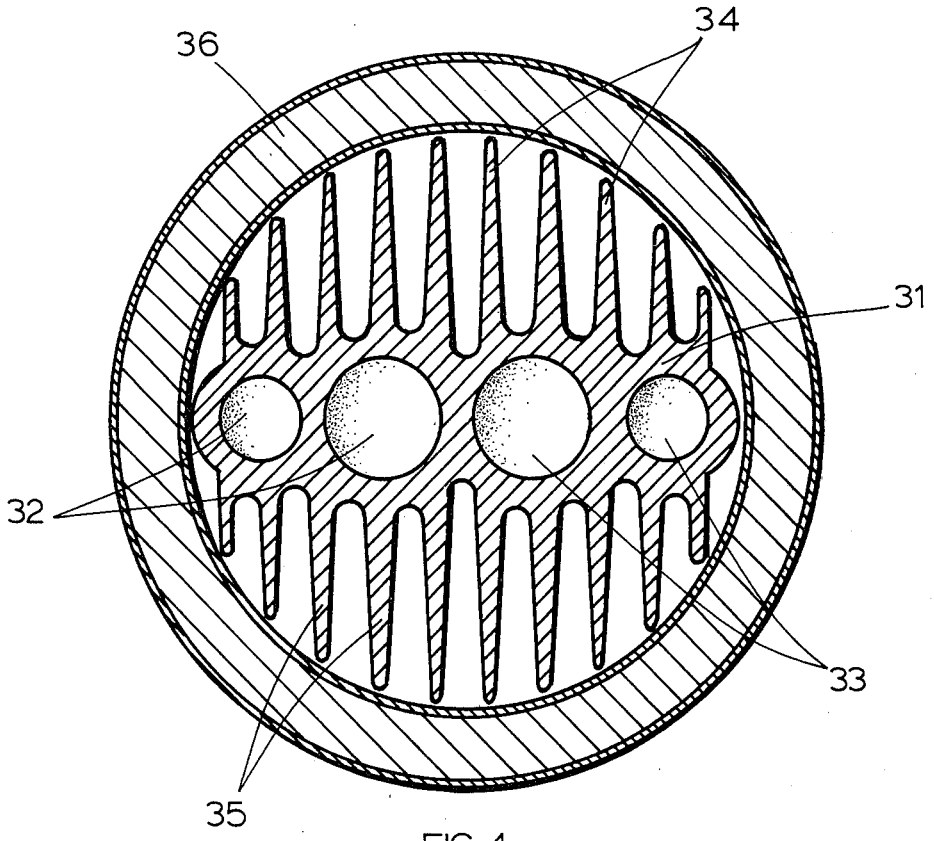
FIG. 4 shows a cross section of a heat exchanger that is externally round.

FIG. 4 shows a variant a heat exchanger having an externally round cross section, so that it is used with a tubular box. Central part 31 contains two sets of liquid ducts 32 and 33. On opposite sides of the longer sides of central part 31, ribs 34 and 35 are respectively situated. The walls of these ribs all have the same angle relative to their central axes. This heat exchanger (31 through 35) can be incorporated in insulating, tubular box 36.

COMPARATIVE EXAMPLE

A central heating boiler was operated first without and subsequently with an energy recovery apparatus according to the present invention. In both cases the load of the boiler was set so that the net power on the water side was 18 kW.

The ambient temperature was 20° C. ($t_o$).

The temperature of the return water from the central heating circuit was 37° C., the exit temperature of the water was 51° C.

The $CO_2$ content of the flue gas was 8%.

The load has in both cases been calculated on the basis of the gross calorific value of Groningen (The Netherlands) natural gas.

| A. Central heating boiler without an energy recovery apparatus | | |
|---|---|---|
| Net water side power | | 18 kW |
| Flue gas temperature ($t_r$): 215° C. | | |
| Chimney losses: 0.05 1 ($t_r$–$t_o$) | 9.95% | |
| Loss of latent heat | 9.85% | |
| Loss by radiation, etc. | 7.20% | |
| Total losses | 27.00% | 6.65 kW |
| Load | | 24.65 kW |

| B. Central heating boiler with an energy recovery apparatus | | |
|---|---|---|
| Net water side power | | 18 kW |
| Flue gas temperature after energy recovery ($t_{re}$): 46° C. | | |
| Chimney losses: 0.051 ($t_{re}$–$t_o$) | 1.33% | |

-continued

| | | |
|---|---|---|
| Loss of latent heat (9.85%–4% profit bij 1.31 condensate/h) | 5.85% | |
| Loss by radiation, etc. (lower than for A. because of lower temperature in combustion zone) | 6.30% | |
| Total losses | 13.48% | 2.8 kW |
| Load | | 20.8 kW |

A central heating boiler with an energy recovery apparatus according to the present invention thus yields an energy saving of 3.85 kW or 15.6% relative to the same boiler without this apparatus. The full load water side efficiency, calculated on the basis of the gross calorific value of Groningen natural gas, is 86.5% for the boiler with this apparatus and only 73% for the boiler without the apparatus.

What is claimed is:

1. An apparatus for recovering energy from the flue gas of a fired heating installation which uses a liquid circuit to transfer heat comprising supply and discharge connections for the flue gas, a heat exchanger incorporated in the liquid circuit, a condensate collection and discharge device, and a fan to force the flue gas past the heat exchanger wherein said heat exchanger has an elongated body with its central part being formed by the walls of two cavities or sets of cavities running parallel in longitudinal direction and said walls of the central part, on both sides of said cavities, have longitudinal ribs, said heat exchanger is placed in a heat insulating box so that the areas between said ribs, the inner wall of said box and the central part of said exchanger form ducts, said supply and discharge connections being connected to said ducts, said ducts of said heat exchanger incline toward a space formed by one end of the ducts and the inner wall of the box, where a downwardly pointing tube is in open connection with said space and the exterior of said box, and means for controlling the flow of flue gas positioned in the flue gas line, and means to pass the liquid of the liquid circuit through said cavities.

2. The apparatus of claim 1 wherein the heat exchanger has a seamless extruded body.

3. The apparatus of claim 2 wherein the circumferential configuration of said heat exchanger is either rectangular or circular.

4. The apparatus of claim 1 wherein said exchanger has from about 10 to about 30 longitudinal ribs and has at least two cavities.

5. The apparatus of claim 1, wherein said fan forms part of said flue gas discharge connection.

6. The apparatus of claim 1 wherein said fan is positioned in said space formed by the ends of the ducts and the inner wall of the box.

7. The apparatus of claim 6 wherein means are present to keep condensed water outside said fan and discharge it through a pipe.

8. The apparatus of claim 1 wherein the connections for the supply and discharge of the flue gases are provided with a detachable cover plate to which said heat exchanger is attached and through which the connections of the liquid circuit are passed.

9. The apparatus of claim 8 wherein said fan is attached to said plate in such a way that together with said plate said heat exchanger and said fan can be removed from said box.

10. The apparatus of claim 8 wherein flexible hoses connect to the supply and discharge lines for the liquid.

11. The apparatus of claim 6 wherein the axis of said fan inclines.

12. The apparatus of claim 1 wherein the flue gas flow control means comprise an orifice plate detachably mounted on the outlet of said fan with an orifice the width of which is adapted to the desired flue gas flow passing through at a certain boiler capacity.

13. The apparatus of claim 1 wherein at least one of the flue gas ducts have a temperature sensor and a gas flow sensor which work together with an electric circuit and can separately and together influence the fuel supply and the operation of the fan.

14. The apparatus of claim 13 wherein said temperature sensor is located in the flue gas supply connection.

15. The apparatus of claim 13 wherein said gas flow sensor is located in said flue gas discharge connection.

16. The apparatus of claim 15 wherein said gas flow sensor is located above said orifice of said orifice plate.

17. The apparatus of claim 1 wherein it is substantially made of aluminium or an alloy of aluminium and the insulation of said box consists of rock wool.

18. The apparatus of claim 1 wherein said box is provided with externally opening vents.

19. The apparatus of claim 1 wherein the connection of the supply and discharge of the liquid medium are electrically insulated from the cavites (12, 13).

* * * * *